United States Patent [19]

Carter

[11] 4,086,945

[45] May 2, 1978

[54] BAG FOR CARRYING MOTION PICTURE FILM CANS OF DIFFERENT SIZES

[76] Inventor: Neal E. Carter, 235 Palisades Ave., Yonkers, N.Y. 10703

[21] Appl. No.: 713,414

[22] Filed: Aug. 11, 1976

[51] Int. Cl.[2] ..... B65D 69/00

[52] U.S. Cl. ..... 150/52 J; 150/28 R; 150/30; 150/34

[58] Field of Search ..... 150/28 R, 30, 34, 42, 150/52 J, 52; 206/391

[56] References Cited

U.S. PATENT DOCUMENTS

| | | | |
|---|---|---|---|
| 1,296,421 | 3/1919 | Miller | 150/34 |
| 1,505,884 | 8/1924 | Goldquist | 150/52 J |
| 1,526,733 | 2/1925 | Albert | 206/315 |
| 1,575,875 | 3/1926 | Szewczyk | 190/52 |
| 1,770,857 | 7/1930 | Marks | 150/1.6 |
| 2,691,401 | 10/1954 | Kontoff | 150/28 R |
| 3,001,566 | 9/1961 | Lipsitz | 150/12 |
| 3,696,850 | 10/1972 | Rosenblum | 190/52 |
| 3,830,348 | 8/1974 | Ohyama | 150/28 R |
| 3,874,435 | 4/1975 | Allen | 150/34 |
| 3,955,609 | 5/1976 | Siegel | 150/35 |

*Primary Examiner*—Ro E. Hart

*Attorney, Agent, or Firm*—Brooks, Haidt, Haffner & Delahunty

[57] ABSTRACT

A carrying bag for flat, cylindrical articles of different sizes, such as cans of motion picture film, has several upwardly opening pockets. A carrying strap is attached to the largest, rear pocket and a belt extends from the rear pocket, over the openings of the pockets, to be secured at the front of the smallest, front pocket, holding the articles in their respective pockets. A flap-like cover extends from the rear of the bag over the tops of the pockets and is large enough to cover the belt and its securing means, to protect the bag contents from the elements, and this flap can be opened to allow inspection of the articles while the belt stays secured to hold the articles within the pockets. A reinforcing member extends across the back of the rear pocket. The underside of the cover flap has a pocket for small articles and documents.

5 Claims, 1 Drawing Figure

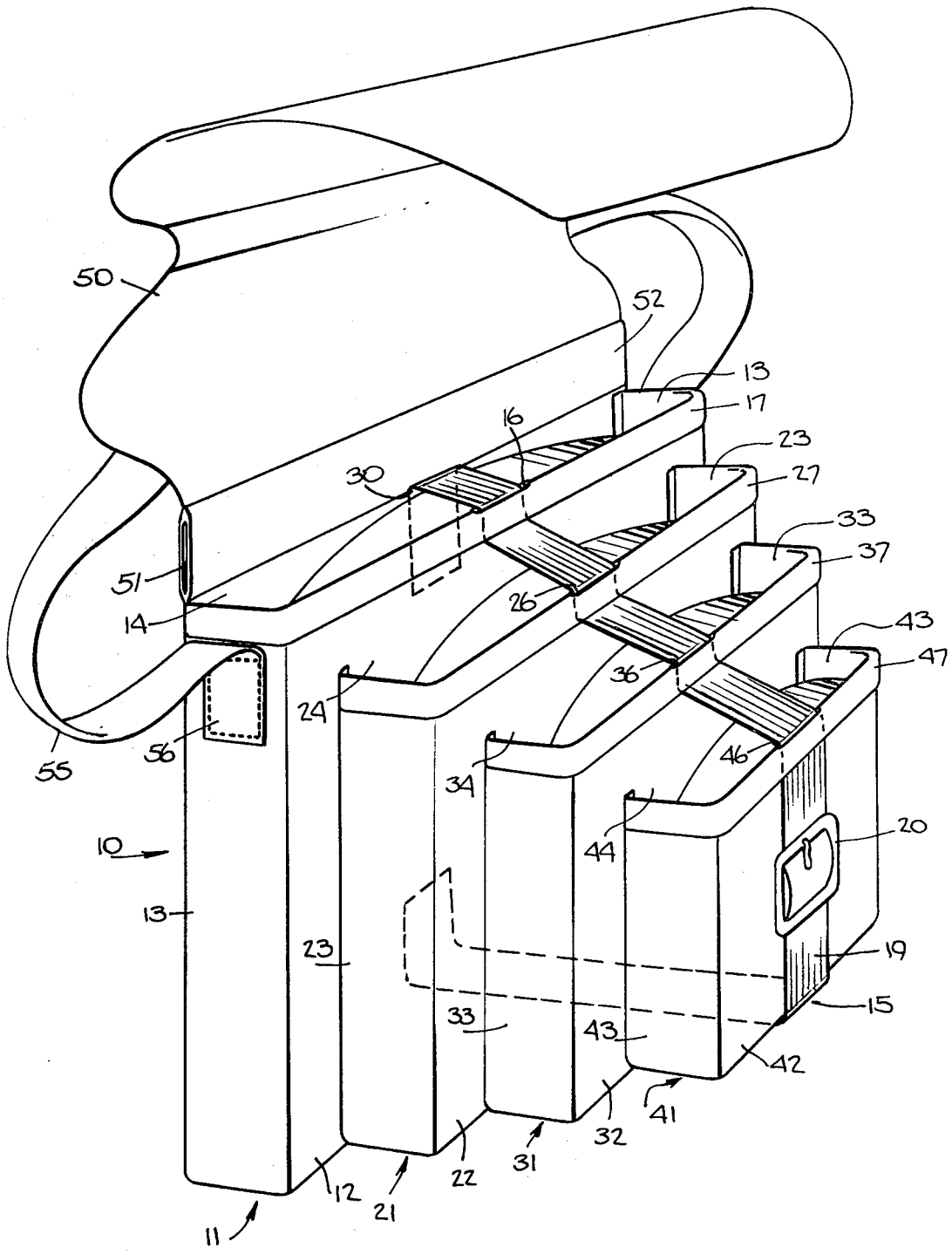
50
52
13
17
16
23
27
30
33
37
51
14
26
43
47
36
24
46
55
56
34
44
20
10
13
23
19
33
15
43
42
41
32
31
22
12
21
11

BAG FOR CARRYING MOTION PICTURE FILM CANS OF DIFFERENT SIZES

BACKGROUND OF THE INVENTION

1. Field of the Invention

The invention relates to baggage, and more particularly to a carrying bag for cans of motion picture film of various sizes.

2. Discussion of the Prior Art

Reels of motion picture film of various standard sizes. such as 400, 800, 1200 and 1600 foot reels of 16 or 35 mm film are usually packed, stored and carried in flat cylindrical metal containers called "cans". Longer motion picture films of course require larger reels and cans of relatively large diameter, so film cans are of a number of standard sizes to suit the ordinary range of film lengths.

Although there are a wide variety of specialized carrying bags for photographic film, equipment and accessories, no commercially available carrying bag is particularly well suited to carrying several cans of motion picture film of different sizes. Films are currently usually carried in rigid corrugated board or plastic or metal cases, often sized to carry several reels of film, but only reels of the same size, such as three 1200 foot reels of film.

SUMMARY OF THE INVENTION

The attractive and convenient film carrying bag of this invention permits one to transport a variety of sizes of motion picture films safely and securely. The bag has several pockets of different sizes for the various sizes of film cans, with a largest pocket at the rear and smaller pockets in descending order of size. The contents of all of these pockets can be easily secured in place by releaseably fastening a belt secured through loops across the open tops of the pockets. A cover flap extends from the back of the large rear pocket for covering the tops of all of the pockets and for covering the belt fastener at the front of the bag to produce an attractive appearance.

A reinforcing rod, preferably of metal, is fitted across the bag at the area where the cover flap joins the bag and is adjacent to the ends of a carrying strap. The bag is of sturdy yet flexible material such as canvas and can be folded or "flattened out"for storage when no articles are in the bag pockets.

These and other features and advantages of the film carrying bag of the invention will be more fully understood from the following detailed description of a preferred embodiment, especially when that description is read in conjunction with the accompanying drawing.

BRIEF DESCRIPTION OF THE DRAWING

The drawing is a view in perspective of a film carrying bag according to the invention.

DETAILED DESCRIPTION OF A PREFERRED EMBODIMENT

As shown in the drawing, the bag 10 of the invention has a series of spaced, parallel, generally rectangular pockets ranging in size from a largest rear pocket 11, through pockets 21 and 31 of intermediate size to a smallest front pocket 41. Although the presently preferred embodiment of the bag has four pockets, the invention can be embodied in a bag having some other number of pockets, say three pockets, or five or more.

Each of the pockets 11, 21, 31 and 41 is generally in the form of an open-topped rectangular box, taller and wider than the thickness of the pocket from front to back, and each pocket corresponds in size to a standard film can.

The largest pocket 11 has a front panel 12, side panels 13, a rear panel 14 and a bottom panel (not shown in the drawing). Similarly the pockets 21, 31 and 41 have front and side panels 22 and 23, 32 and 33, 42 and 43 respectively, as well as bottom panels (not shown).

Depending on the manner of construction of the bag, the smaller pockets 21, 31 and 41 can have rear panels 24, 34 and 44 as shown in the drawing; preferably the front panel of the next larger pocket serves as the back of each of the smaller pockets. If each of the pockets 11, 21, 31 and 41 has its own front, back, bottom and sides and is, in effect an independent pouch, the bag 10 is manufactured by attaching the back panel of each pocket to the front panel of the pocket next larger in size.

The preferred material for most parts of the bag 10 is sturdy canvas or some other strong and wear resistant textile fabric, whether made of natural or artificial fibers or a mixture of natural and artificial fibers, but the bag could also be fashioned of leather or some flexible synthetic resinous material such as vinyl or of a textile fabric laminated, impregnated or coated with a synthetic resin. The basic material should be sturdy yet flexible. When formed of textile fabric the parts are preferably sewn together, but other means of joining the bag parts suited to the materials used will suggest themselves to those acquainted with the fabrication of luggage. It is presently preferred to construct the bag of 18 oz. waterproofed canvas, able to withstand a weight load of 35 to 50 pounds "dead weight".

It will be seen that the base or bottom 15 of the bag 10 is flat, all of the pockets 11, 21, 31 and 41 having their bottom panels coplanar so that the bag 10 will stand upright on a flat horizontal surface.

Film cans are rigid, so when the several pockets 11–41 are filled, the bag 10 will assume the shape shown in the drawing. For storage, an empty bag 10 can be flattened out. When one or more of the pockets 11–41 does not contain a film can, but there is at least one full pocket, the empty pocket or pockets will fold flat.

To secure film cans or other articles in the pockets of the bag 10, a belt 18, extends from the rear panel 14 to be releaseably secured to a shorter belt section 19 at the front 42 of the bag 10 by means of a buckle 20, or other suitable fastener. When one or more of the pockets is empty and collapsed the belt 18 is shortened to hold the empty pocket or pockets closed.

A slot or loop 16 is provided centrally near the top of the front panel 12 of the pocket 11 and each of the other pockets 21, 31 and 41 has a similar slot 26, 36 and 46 respectively for reception of the belt 18 which is threaded through the slots 16, 26, 36 and 46 in the manner shown in the drawing for securely holding film cans or other articles in place when the buckle 20 is closed. These slots or loops are preferably secured with extra heavy duty stitching.

In the illustrated embodiment, in which the bag 10 is of canvas or some other sturdy textile fabric, each pocket has a hem, that is an area of double thickness of bag material at the pocket top. These hems are indicated in the drawing by reference numerals 17, 27, 37 and 47 and serve to reinforce the pockets at the area of passage of the belt, 18 through the slots 16, 26, 36 and 46.

The end of the belt 18 remote from the buckle 20 can be sewn or otherwise attached to the rear panel 14 of the bag 10 and can then pass through a slot 30 as shown in the drawing to provide a sturdy package and an attractive appearance.

To protect the bag contents against the elements, a flap-like cover 50 extends from the rear panel 14 and is preferably formed integrally therewith. The cover 50 is of the material of which the bag is basically made and is accordingly flexible yet strong. As shown the flap-like cover 50 is sized to cover all of the pockets, and also to cover the buckle 20 when the flap is in closed position. If desired, means for securing the cover 50 in place could be provided on the cover 50 and on the front panel 42 of the smallest pocket 41. A reinforcing rod or bar 51 extends across the width of the cover 50 through a passage at 52 provided by a double thickness of the bag material adjacent the area where the rear panel 14 is attached to the cover 50. The rod or bar 51 can be of metal such as steel and serves to hold the pockets of the bag open across their width while reinforcing the bag 10. Advertising material or identifying indicia can be placed or printed on the outer surface of the cover 50, and the cover 50 can have an internal pocket for papers or the like.

Also shown in the drawing is a carrying strap 55 secured at its ends 56 to the side panels 13 of the largest bag pocket 11. The ends 56 of the strap 55 are thus near the reinforcing bar 51 so that stress on the bag 10 when the bag is supported by the strap 55 is borne by the rod 51, keeping the bag 10 in shape. Preferably the strap 50 is tapered so as to be wider at its middle area for more comfortable over-the-shoulder carrying.

The strap 55 is preferably long enough to allow the bag to be carried in over-the-shoulder fashion, and of course the strap 55 can be adjustable in length if desired.

In view of the foregoing description of a presently preferred embodiment, numerous modifications, adaptations, choices of material and uses of the bag of the invention will suggest themselves and are to be considered within the spirit and scope of the invention.

What is claimed is:

1. A bag for carrying articles such as different sized cans of motion picture film, comprising a series of upwardly opening generally rectangular pockets, joined together and arranged stepwise from a smallest front pocket to a largest rear pocket with at least one intermediate pocket, all of said pockets being rectangular and similar in shape with rectangular rear, front, side and bottom panels, the depth and width of each pocket being substantially greater than the distance from front to back of such pocket, a central loop means at the upper part of the front panel of each pocket and a belt arranged to fit slidingly through said slots for releasable attachment at the front of the bag to secure articles within the pockets, a cover flap attached to the rear panel of the largest of the pockets for covering all of the pockets, a reinforcing member extending across the width of said cover within the cover parallel and adjacent to a line along which the cover joins said rear panel of said largest pocket, and a carrying strap attached to upper portions of opposite side panels of said largest pocket.

2. The bag of claim 1 wherein said front, rear, side and bottom panels are formed of sturdy and flexible textile fabric.

3. The bag of claim 1 wherein said belt is releasably attachable by means of a buckle carried by a short belt section attached to the front of the bag.

4. The bag of claim 1 wherein said panels are all formed of flexible material and said slots pass through areas where said flexible material is of double thickness.

5. The bag of claim 1 wherein there are four pockets, each of said pockets being dimensioned to receive a film can of a standard size.

* * * * *